US008337114B2

(12) United States Patent
Course

(10) Patent No.: US 8,337,114 B2
(45) Date of Patent: Dec. 25, 2012

(54) BARRIER SYSTEM

(75) Inventor: Mike Course, Maidstone (GB)

(73) Assignee: Highway Care Limited, Kent ( * ) Notice: Subject to any disclaimer, the term of this patent is extended or adjusted under 35 U.S.C. 154(b) by 249 days.

(21) Appl. No.: 12/677,624

(22) PCT Filed: Sep. 10, 2008

(86) PCT No.: PCT/GB2008/003058

§ 371 (c)(1),
(2), (4) Date: Jun. 7, 2010

(87) PCT Pub. No.: WO2009/034311

PCT Pub. Date: Mar. 19, 2009

(65) Prior Publication Data

US 2010/0254759 A1 Oct. 7, 2010

(30) Foreign Application Priority Data

Sep. 13, 2007 (GB) ..... 0717841.1

(51) Int. Cl.
*E01F 13/00* (2006.01)

(52) U.S. Cl. ..... 404/6; 256/13.1

(58) Field of Classification Search ..... 404/6; 256/13.1
See application file for complete search history.

(56) References Cited

U.S. PATENT DOCUMENTS

| | | | | |
|---|---|---|---|---|
| 1,564,337 | A * | 12/1925 | Fischbach | 238/10 E |
| 3,436,057 | A * | 4/1969 | Mazelsky | 256/13.1 |
| 3,705,709 | A | 12/1972 | Andriussi | |
| 4,290,585 | A * | 9/1981 | Glaesener | 256/13.1 |
| 4,934,661 | A | 6/1990 | Denman et al. | |
| 5,957,616 | A | 9/1999 | Fitch | |
| 6,276,667 | B1 * | 8/2001 | Arthur | 256/13.1 |
| 6,340,268 | B1 * | 1/2002 | Alberson et al. | 404/6 |
| 6,533,250 | B2 * | 3/2003 | Arthur | 256/13.1 |
| 6,702,513 | B1 * | 3/2004 | Raupach | 404/6 |
| 6,835,024 | B1 | 12/2004 | Gertz | |
| 6,926,461 | B1 * | 8/2005 | Faller et al. | 404/6 |
| 7,104,720 | B2 * | 9/2006 | Humphries et al. | 404/6 |
| 7,481,600 | B2 * | 1/2009 | Barton | 404/10 |
| 2005/0104054 | A1 | 5/2005 | Humphries et al. | |
| 2006/0018711 | A1 | 1/2006 | Rogers et al. | |

FOREIGN PATENT DOCUMENTS

| | | |
|---|---|---|
| BE | 660089 | 6/1965 |
| DE | 2851204 | 6/1980 |
| FR | 2508511 | 12/1982 |

* cited by examiner

*Primary Examiner* — Gary S Hartmann
(74) *Attorney, Agent, or Firm* — Woodard, Emhardt, Moriarty, McNett & Henry LLP

(57) ABSTRACT

A barrier system is provided including at least a first front barrier and at least a second rear barrier. The second rear barrier is located a pre-determined spaced distance behind the front barrier. At least a part of said second rear barrier is substantially greater in height than the height of said first front barrier.

16 Claims, 8 Drawing Sheets

BARRIER SYSTEM

BACKGROUND

This invention relates to a barrier system, and particularly but not necessarily exclusively to a barrier system designed for substantially absorbing the energy of an object, such as a vehicle, impacting therewith.

It is becoming increasingly common for safety barriers to be placed outside the front of buildings, such as government offices, airports, conference centres and/or the like, to prevent unauthorised third parties from driving too close or into said buildings. This is particularly the case since the risk of terrorist attack on certain buildings has significantly increased in recent years. However, a problem with conventional safety barriers is that they are insufficiently strong or of insufficient dimensions to adequately protect the buildings. Large concrete or steel walls could be built in front of the buildings to add protection but such measures are likely to incur significant cost, restrict authorised access to the buildings and significantly reduce the aesthetic appearance of the buildings.

It is therefore an aim of the present invention to provide a barrier system which overcomes the abovementioned problems.

It is a further aim of the present invention to provide a method of using a barrier system.

SUMMARY

According to a first aspect of the present invention there is provided a vehicle safety barrier system, said barrier system including at least a first front vehicle barrier means and at least a second separate rear vehicle barrier means, said at least second rear barrier means located a pre-determined spaced distance behind said first front barrier means, at least a part of said second rear barrier means is substantially greater in height than the height of said first front barrier means, the second rear barrier means including an attachment portion for attaching said second rear barrier means to the ground or suitable surface on which it is to be located in use, an impact portion and support means for supporting the impact portion in a required position, and wherein the first front barrier means has a front surface, a rear surface, a top and a base, the front surface being substantially continuous in form from the base to the top, and the second rear barrier means is non-continuous in form, the support means having a frame including a plurality of frame members joined together with spaces between some of the frame members.

As such, the barrier system of the present invention allows an object, such as for example a vehicle, to impact with the front barrier means. If the front barrier means are insufficient to absorb all the energy from this impact or, if the object impacting the first barrier means is larger in dimensions than can be adequately contained by the first barrier means, the second barrier means absorbs the remaining energy of the impact of said object and/or contains the object. Thus, the barrier system of the present invention provides at least two separate barriers working at different heights to provide a more effective combined safety system.

The rear barrier means is typically positioned closest to a building, object and/or area to be protected by the barrier system in use. The front barrier means is typically located a distance further from the building, object and/or area to be protected by the barrier system in use than the rear barrier means. The front barrier means is typically positioned closer to a roadway or vehicle access point adjacent the building, object and/or area being protected than the second rear barrier means. Thus, a vehicle or object is most likely to impact with the first front barrier means prior to impact with the second rear barrier means.

The at least second rear barrier means has an impact portion and said impact portion is provided at a height substantially greater than the height of said first front barrier means (i.e. there is a spaced distance apart between the top of the front barrier means and the base of the impact portion).

In one embodiment the impact portion is a substantially continuous member made from strong and/or reinforced material.

In one embodiment the attachment portion is anchored in a ground surface on which the at least second rear barrier means is placed in use. Further preferably the attachment portion is provided at or adjacent a base of the second rear barrier means.

The attachment portion can include any or any combination of one or more screws, nuts and bolts, pins, adhesive, welding, cement and/or the like.

Preferably the support means is provided at least partly between the impact portion and the attachment portion.

The frame of the support means is provided in such a manner so as to provide sufficient strength and rigidity to the second barrier means structure whilst using the minimum amount of material and minimising the aesthetic impact of the barrier means in the locality in which it is placed in use. For example, use of a plurality of elongate, arm like frame members joined together. Spaces can be defined between at least some of the frame members, thereby allowing light to pass through a part of the structure compared to providing a solid or continuous housing.

Preferably the impact portion runs substantially parallel to a front surface of the barrier system or first front barrier means. Further preferably the impact portion is located adjacent a top of the support means.

Preferably the impact portion is substantially elongate in form and preferably a longitudinal axis of said portion is substantially parallel to a front surface or edge of said barrier system.

Preferably at least part of the support means or frame means are provided substantially perpendicular to the impact portion (i.e. to the longitudinal axis of the impact portion) or laterally thereof. The frame means preferably extends behind said impact portion, such that on impact of an object with a front of said impact portion, the rear barrier means is substantially prevented from moving backwards, such as towards a building, object and/or area being protected or away from the first front barrier means.

In one embodiment the front barrier means is substantially solid in form.

The front barrier means can be any suitable type of barrier means. Attachment means can be provided on or associated with the front barrier means for anchoring the same to a required surface in use. Preferably the required surface is a ground surface on which the front barrier means is to be located on in use. The attachment means can include any or any combination of one or more screws, nuts and bolts, pins, adhesive, welding, cement and/or the like.

Preferably the front barrier means is of height substantially between 800-900 mm In one embodiment the front barrier means is a step barrier.

Preferably an upper barrier is locatable on the front barrier means if required. The upper barrier can be attached to any suitable surface of the front barrier means and in a preferred embodiment is attached to a top surface of the front barrier means.

The upper barrier can increase the total height of the front barrier means above the height of the second rear barrier means.

The upper barrier can take any suitable form, such as a fence panel, mesh and/or the like.

Preferably the upper barrier is detachably attached to the front barrier means via any suitable attachment means.

Preferably the front and rear barrier means are positioned substantially independently of each other in use (i.e. there is no attachment between said barrier means in one embodiment).

The at least first and second barrier means can be formed from the same or different material. In one example, the barrier means are both formed from metal.

The at least first and second barrier means can be provided in a plurality of parts which are joined together before or when assembling the barrier system in use. The parts can be engaged together via engagement means. The engagement means can include any or any combination of welding, one or more screws, ties, clips, nuts and bolts inter-engaging members and/or the like. This allows a barrier system of a required size and shape to be easily transported and constructed on site.

Further barrier means can be provided with the barrier system if required.

According to a second aspect of the present invention there is provided a method of constructing a vehicle safety barrier system, said barrier system including at least a first front vehicle barrier means and at least a second separate rear vehicle barrier means, at least part of said second rear barrier means is substantially greater in height than said first front barrier means, said second rear barrier means including an impact portion and support means for supporting the impact portion in a required position, said method including the step of locating the at least second rear barrier means a pre-determined spaced distance apart from said first front barrier means, attaching the second barrier means to the ground or a suitable surface on which it is to be located in use, and wherein the first front barrier means has a front surface, a rear surface, a top and a base, the front surface being substantially continuous in form from the base to the top, and the second rear barrier means is non-continuous in form, the support means having a frame including a plurality of frame members joined together with spaces between some of the frame members.

According to a further independent aspects of the present invention there is provided rear barrier means for use in a barrier system.

DESCRIPTION OF THE SELECTED EMBODIMENTS

Figure 1A:
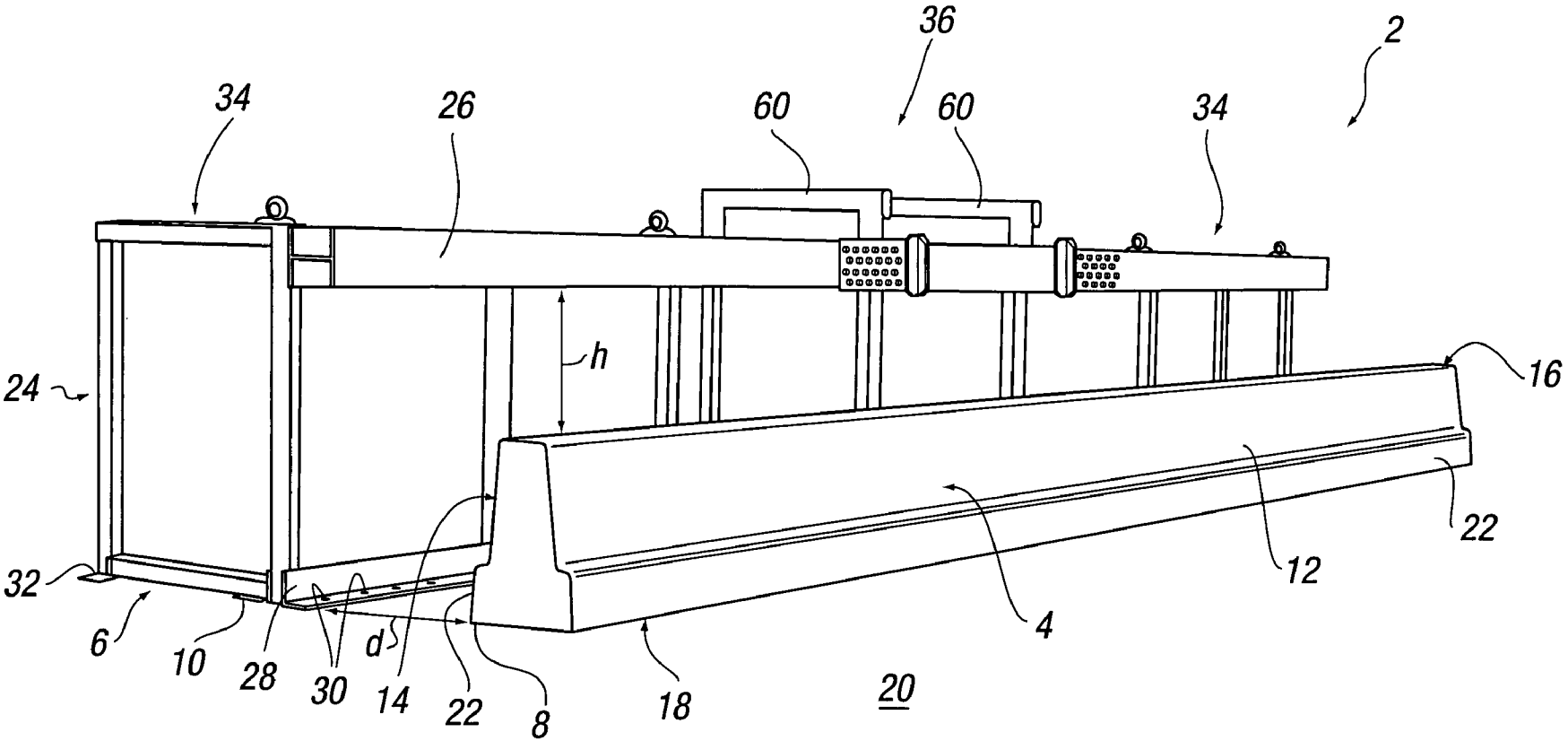
FIGS. 1*a* and 1*b* illustrate front and rear perspective views of the barrier system according to one embodiment of the present invention respectively.
Figure 1B:
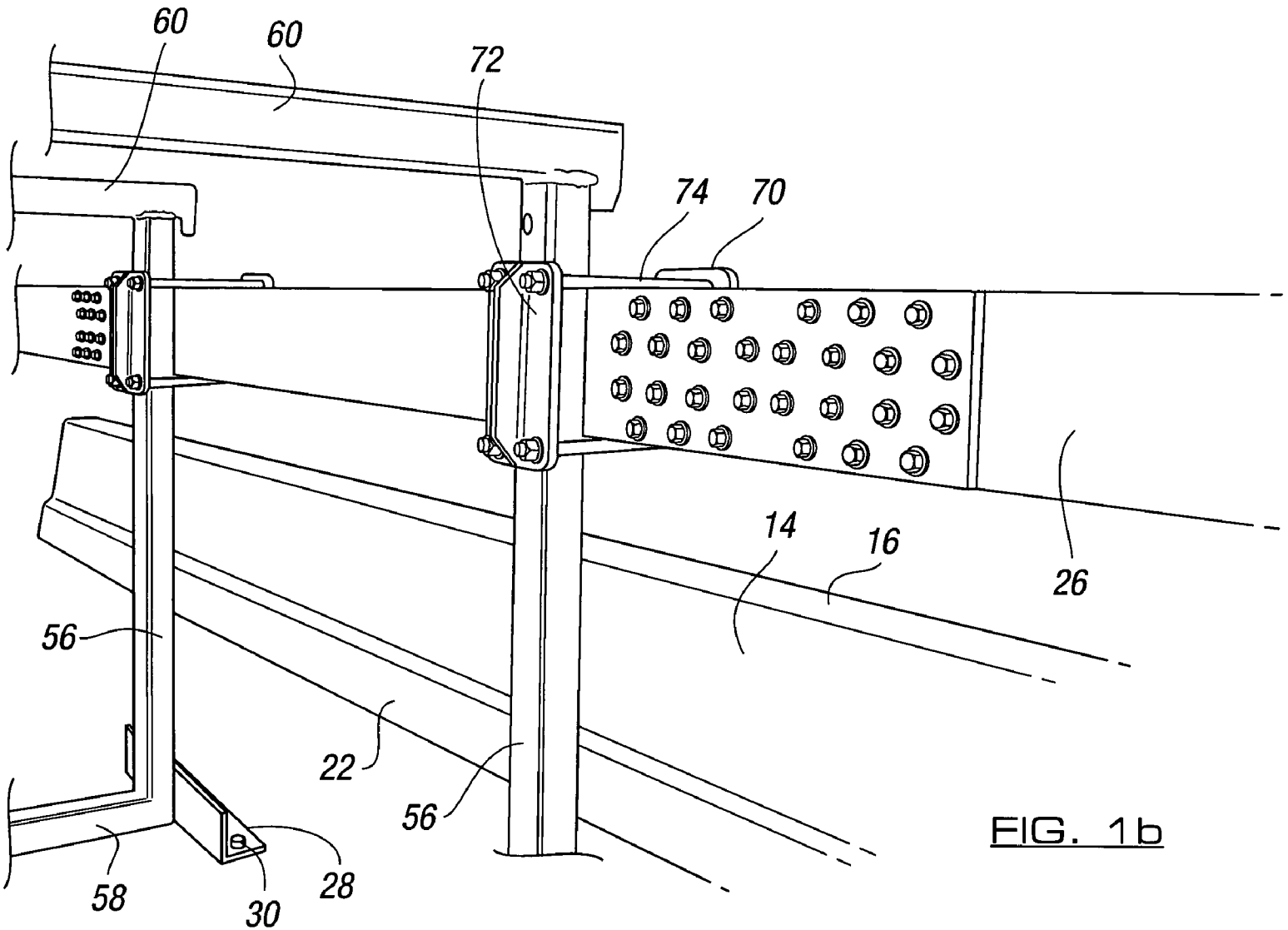

Referring to FIGS. 1*a*-1*b*, there is illustrated a barrier system 2 including a front barrier 4 and a rear barrier 6. A rear base 8 of the front barrier 4 is located a spaced distance 'd' apart from the front base 10 of rear barrier 6 in use.

The front barrier 4 is substantially continuous in form having a front surface 12, a rear surface 14, a top 16 and a base 18. Attachment means (not shown) attach base 18 to ground surface 20 in use. Both the front and rear surfaces 12, 14 are provided with a protruding step 22 adjacent base 18 thereof that protrudes outwardly of each of said surfaces (this barrier is often called a step barrier).

The rear barrier 6 is typically non-continuous in form having a frame 24 including a plurality of frame members joined together with spaces between some of the frame members. An impact portion in the form of a front facing elongate arm 26 is provided on a front of frame 24 and at a pre-determined height 'h' above top 16 of front barrier 4. A space is formed between the top of front barrier 4 and the base of the elongate arm 26. The longitudinal axis of arm 26 is substantially parallel to a front surface or edge of front barrier 4.

An attachment portion in the form of an L-shaped foot 28 attaches a base of a front of frame 24 to ground surface 20 in use. A plurality of bolts 30 are provided through suitable shaped apertures in foot 28 and are secured into ground surface 20. Rear attachment plates 32 are also provided for anchoring the rear of frame 24 adjacent a base thereof to ground surface 20 in use.

Figure 3A:
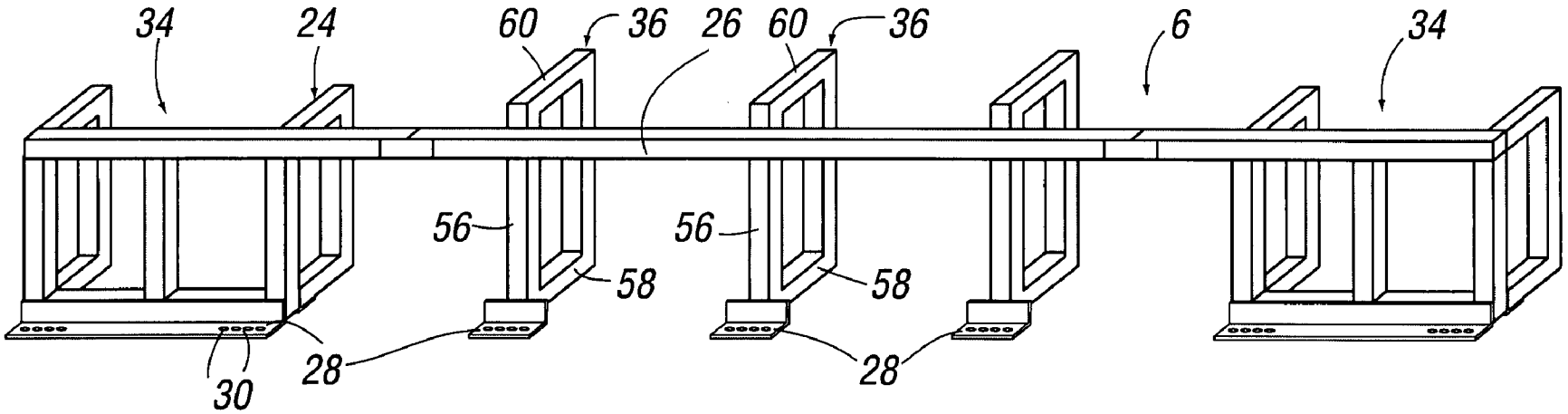
FIGS. 3*a*-3*c* illustrate a front view of the rear barrier means according to an embodiment of the present invention, a detailed view of an end section of the rear barrier means and a detailed view of a frame section of the rear barrier means respectively.
Figure 3B:
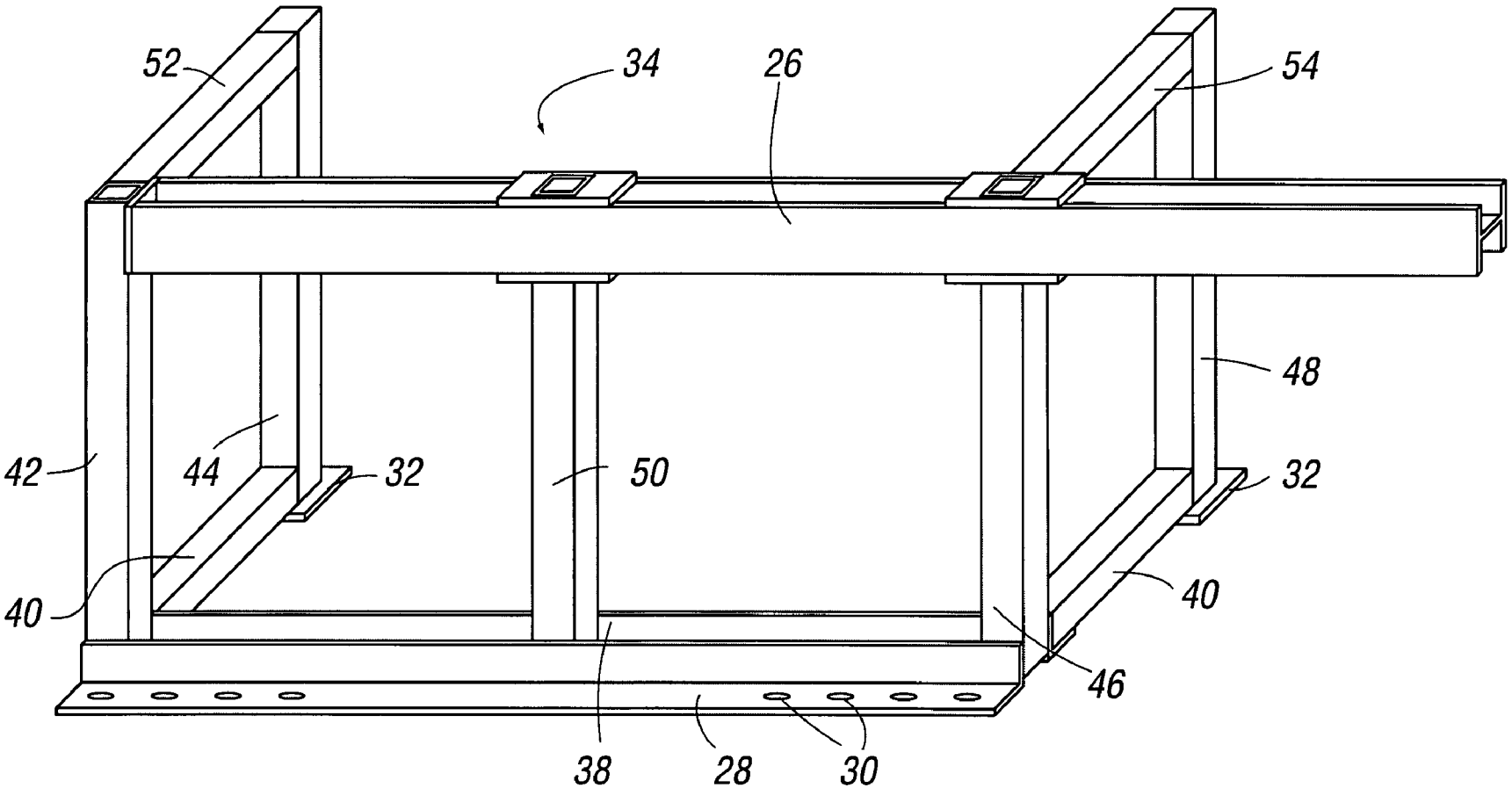

In the illustrated example and as shown in FIG. 3*b*, frame 24 includes frame members joined together or integrally formed to provide end sections 34 and intermediate sections 36. Each end section 34 includes at least one front base member 38 provided substantially parallel to impact arm 26, and two lateral base members 40 protruding substantially perpendicular to the rear of base member 38. The base members 38, 40 form a substantially U-shape frame base for the second barrier 6. Upright frame members 42, 44, 46, 48 are provided at each corner of the U-shape frame base and an intermediate frame member 50 is provided between corner frame members 42 and 46. Impact arm 26 is joined to the top of upright frame members 42, 50, 46. Top frame members 52, 54 are located between the top of upright frame members 42, 44 and 46, 48 respectively.

Although the shape and dimensions of the frame for the second barrier 6 can be adjusted according to the application of use and the likely impact force that may be applied to the barrier in use, an example of dimensions for the rectangular shaped frame means is now given. Lateral base members 40 are typically approximately 1.2 m long. The front base member is approximately 3 m long and the impact arm is approximately 12 m long (the end terminals are approximately 4.5 m long). The height of the upright frame members 42, 44, 46, 48 are approximately 1.60 m. The frame means could be substantially triangular in shape or any other suitable shape.

The frame members can be joined together in the required arrangement via welding, adhesive, one or more nuts and bolts, inter-engaging members and/or the like. The arrangement of the frame members provides a frame for supporting the impact arm 26 which is both strong and rigid, whilst using the minimum amount of material to make it as lightweight and easy to fit as possible, to reduce the cost of the same and to reduce the aesthetic impact the barrier 6 has in the locality in which it is used.

Intermediate sections 36 include an upright member 56 provided between foot plate 28 and elongate impact arm 26, a lateral base member 58 and a lateral top member 60 protruding substantially perpendicular to upright member 56, and a rear upright member 62. The arrangement of the intermediate section forms a square or rectangle protruding rearwardly of impact arm 26.

Each intermediate section 36 is preferably located 3 meters apart.

Figure 3C:
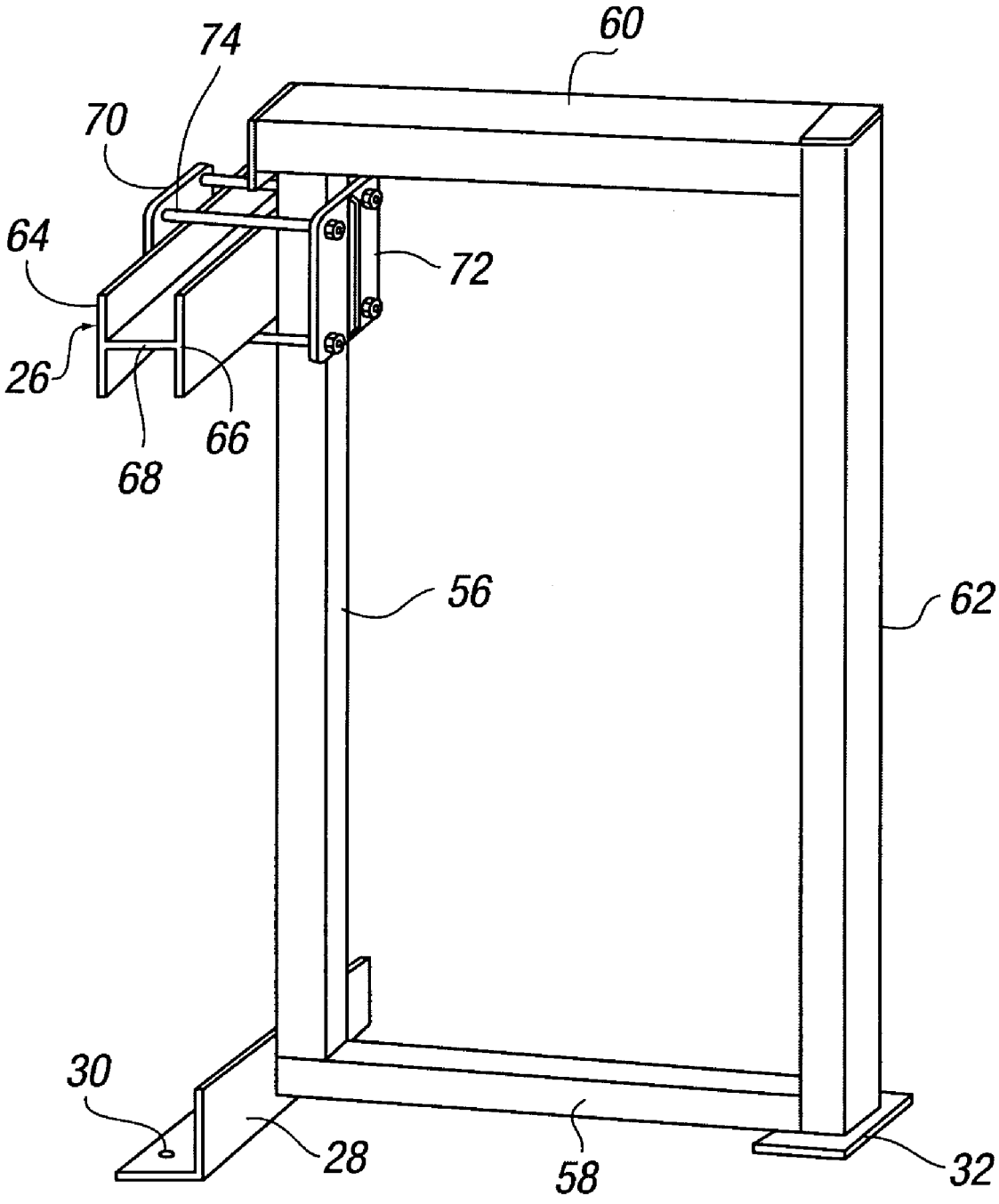

Elongate arm 26 in the illustrated example can include a front plate 64, a rear plate 66 and a joining section 68 provided substantially centrally and perpendicular to said plates 64, 66, as shown in FIG. 3*c*. Arm 26 is clamped to front upright frame member 56 via a front connecting plate 70 and a rear connecting plate 72 with a plurality of bolts 74 passing therebetween. This acts as an additional strengthening means to the rear barrier 6. The lateral frame members are approximately 1.2 m long, the rear upright member is approximately 1.85 m long and the middle of impact arm 26 is preferably 1.05 m above the ground surface.

As such, it can be seen that the middle of impact arm 26 is approximately at least 20 cm higher than the top 16 of front barrier 4. As such, if an object, such as a vehicle 'v' impacts with front barrier 4 and said barrier 4 is insufficiently strong to absorb or contain all the force or parts of the vehicle on the front side of barrier 4, front barrier 4 is typically crushed against rear barrier 6 and rear barrier 6 typically takes up the remainder of the energy from the impact without allowing the vehicle to pass to the rear of barrier 6.

Figure 2A:
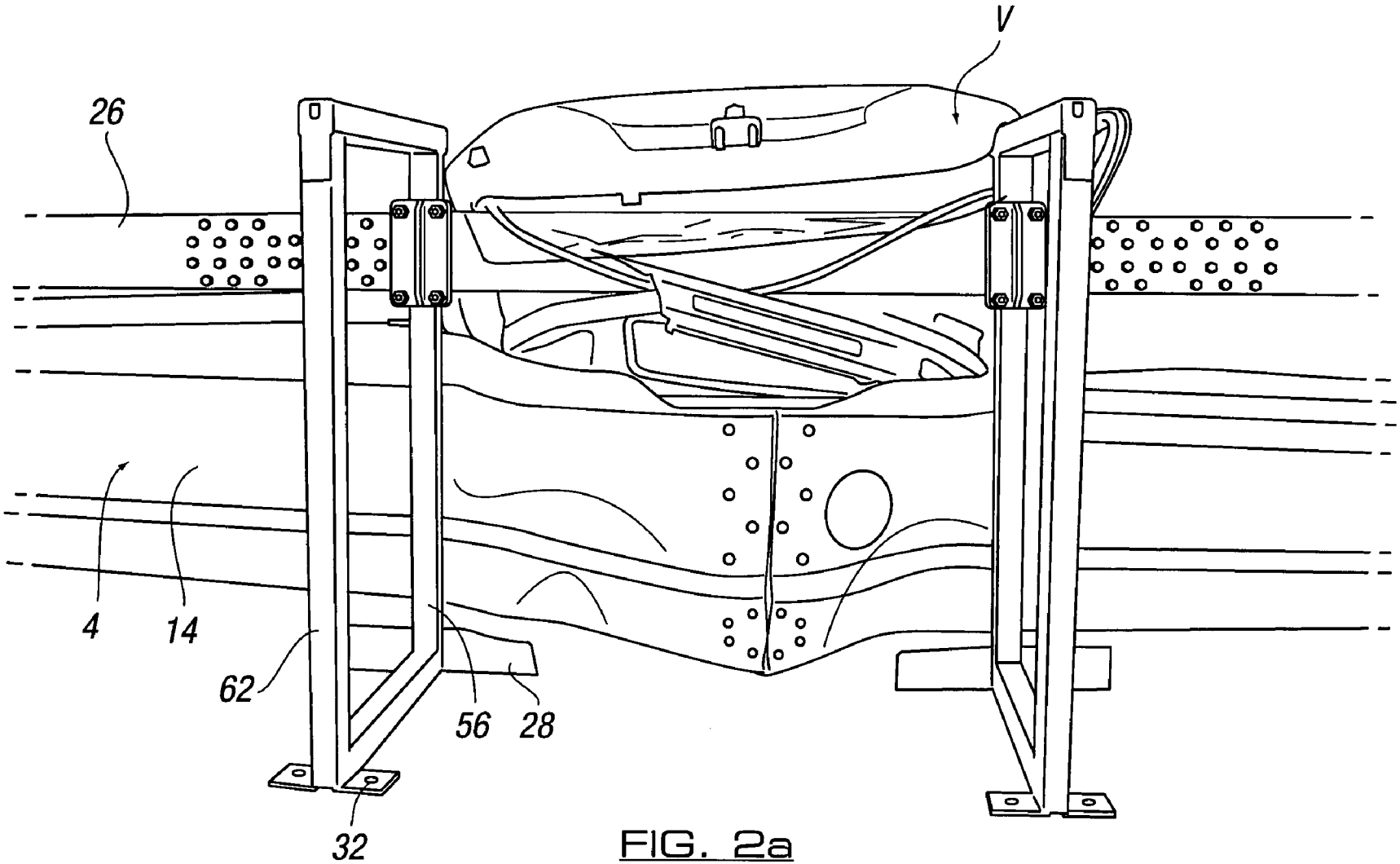
FIG. 2*a* illustrates a view of the barrier system from the rear following impact of a vehicle therewith.

The distance 'd' of the rear of the front barrier 4 from the front of the rear barrier 6 is such so as to prevent a base of the front barrier 4 from pivoting against a front of rear barrier 6 to form a ramp for a vehicle 'v' to drive up following an impact with the front barrier, whilst allowing a top section of the front barrier 4 to impact at least partially against a part of rear barrier 6 (i.e. such as for example a front part) if sufficient force is applied to the front barrier 4 to cause said barrier to fail, collapse or move, thus allowing the rear barrier to absorb at least part of the energy from the impact, as shown in FIG. 2*a*. For example, could be substantially equal to or slightly less than the height of the front barrier means.

Figure 2B:
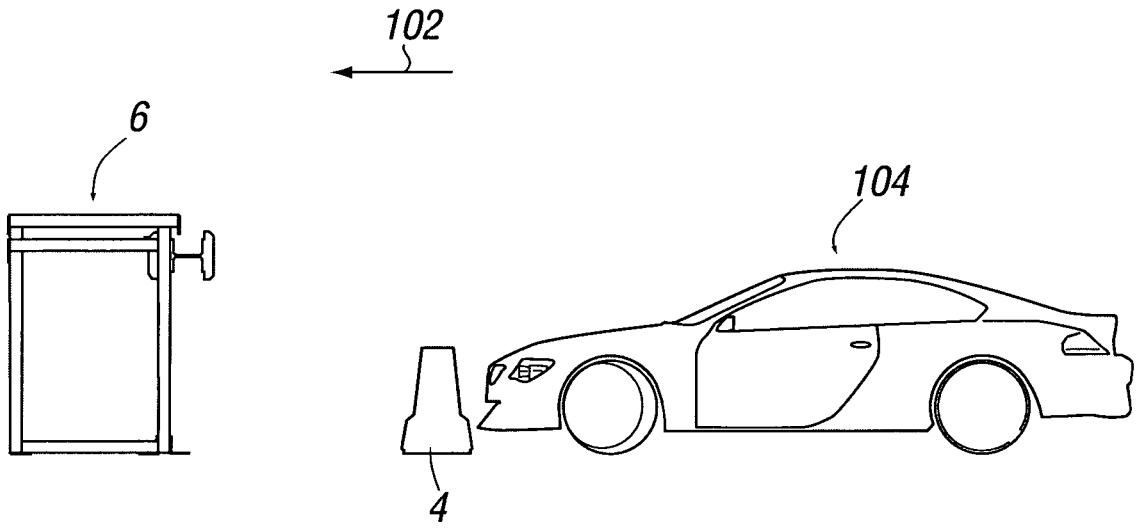
FIGS. 2*b* & 2*c* illustrate a side view of the barrier system prior to impact with a small vehicle in the form of a car and a large vehicle in the form of a lorry respectively.
Figure 2C:
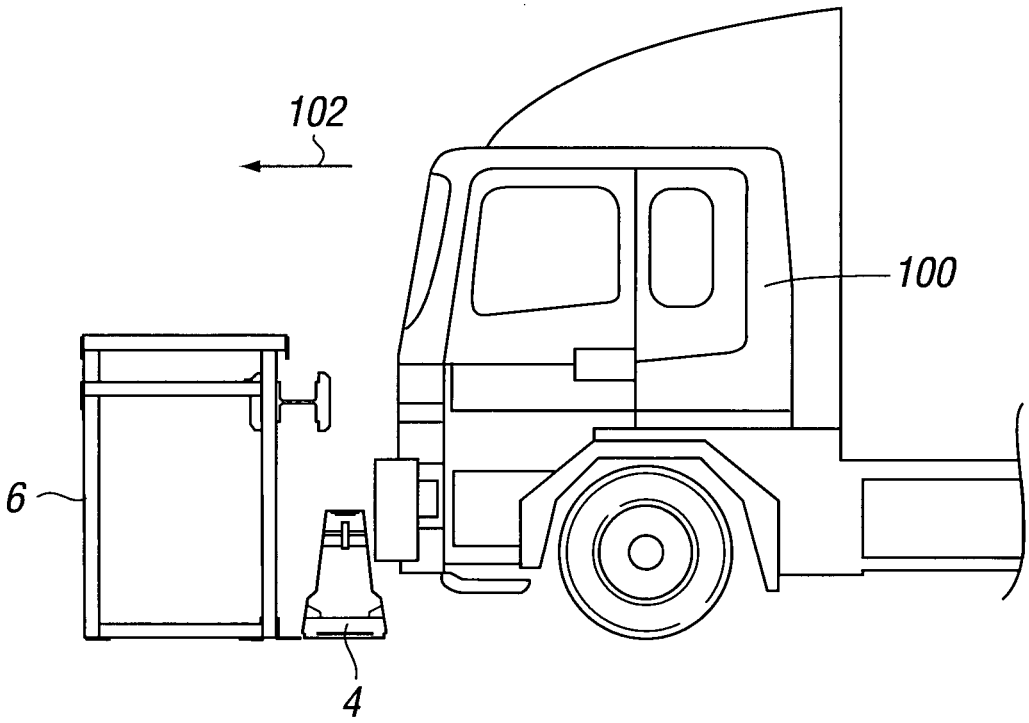

FIGS. 2*b* and 2*c* illustrate the importance of the taller rear barrier 6 when a larger vehicle such as a lorry 100 impacts the barrier system. Whilst the smaller front barrier 4 acts to reduce the speed of lorry 100 on impact therewith, the larger rear barrier 6 will absorb the remaining kinetic energy of the lorry as it travels in the direction of arrow 102. The front barrier 4 may be sufficient to absorb all the energy of impact with a smaller vehicle such as a car 104. In the case of impact with a smaller vehicle 104, the space between barriers 4, 6 can be larger than the space between barrier 4,6 when impacted by a larger vehicle 100. The distance between the front and rear barriers is therefore determined at least partly by the space available to locate the barrier system in and the type of vehicles that the barrier system is designed to prevent access through.

Assembly 70, 72, 74 is adjustable to allow adjustment to be made between the height of arm 26 and the surface height that base frame 62 is anchored to. Preferably the arm 26 remains at a set height of 1630 mm in one embodiment but the frame 62 can be raised and lowered as required, thereby allowing the solid structure to be anchored at plate 32, 28 at different surface heights.

In one example, the distance of the rear lower edge of the front barrier from the front surface of the rear barrier is 800 mm. There is a height difference of 1054 mm from the top surface of the front barrier to the height of the lower edge of the arm 26.

The dimensions of the front barrier in one example are 540 mm width at the base, 230 mm width at the top and is 800 mm high. A further example of the dimensions of a front barrier, often referred to as a step barrier, is 540 mm width at the base, 200 mm at the top and is 900 mm high.

Figure 4:
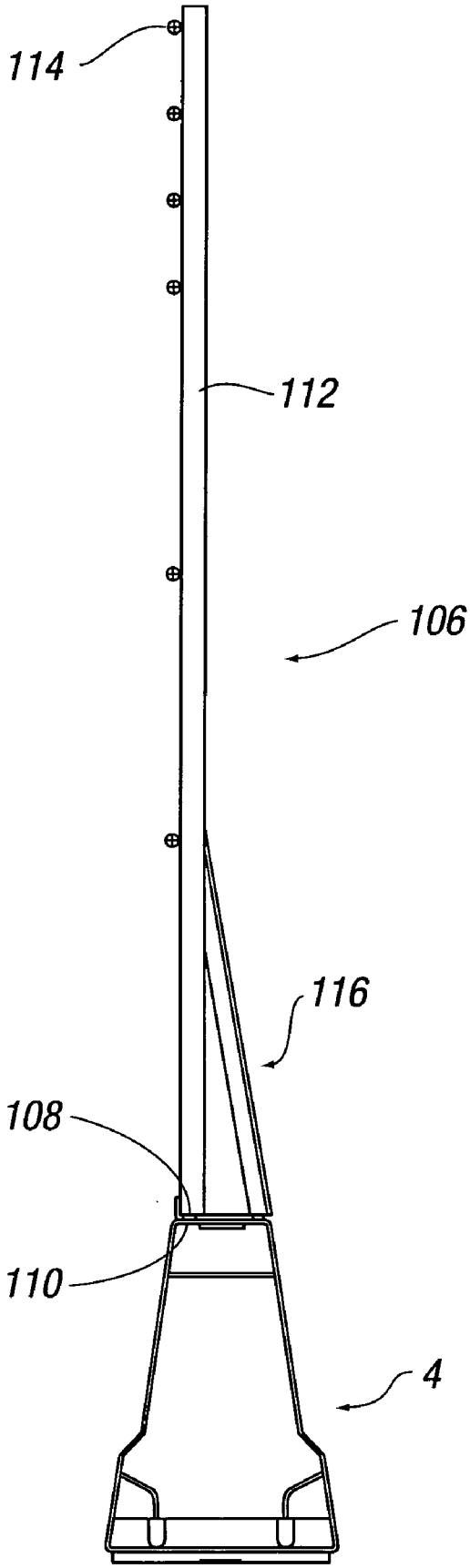
FIG. 4 illustrates a side view of an alternative embodiment of the present invention in which an upper barrier is located on top of the front barrier of the barrier system.

Referring to FIG. 4, there is illustrated an alternative embodiment of the barrier system in which the front barrier 4 has an upper barrier 106 located therewith. In this example, a base 108 of upper barrier 106 is welded to a top 110 of front barrier 4. The upper barrier increases the overall height of the front barrier.

Upper barrier 106 is in the form of a wire mesh fence with an outer frame 112 and substantially horizontal wire bushes 114 located between the sides of the frame.

An anti-visibility panel 116 can be secured to a front of the upper barrier 106 if required. In this example, panel 116 is located at an acute angle to the vertical between a front top edge of the front barrier and a spaced distance above a rear top edge of the barrier.

The invention claimed is:

1. A vehicle safety barrier system, said barrier system including at least a first front barrier and at least a second separate rear barrier, said at least second rear barrier located a pre-determined spaced distance behind said first front barrier, at least a part of said second rear barrier is substantially greater in height than the height of said first front barrier, the second rear barrier including an attachment portion for attaching said second rear barrier to the surface on which it is to be located in use, an impact portion and support means for supporting the impact portion, and wherein the first front barrier has a front surface, a rear surface, a top and a base, the front surface being substantially continuous in form from the base to the top, and the second rear barrier is non-continuous in form, the support means having a frame including a plurality of frame members joined together with spaces between some of the frame members.

2. A vehicle safety barrier system according to claim 1 wherein the pre-determined spaced distance between the first front and second rear barrier is substantially equal to or slightly less than the height of the first front barrier so as to prevent the first front barrier from pivoting against a front of the second rear barrier to form a ramp for a vehicle to drive up following an impact with the first front barrier, while allowing a top section of the first front barrier to impact at least partially against a part of the second rear barrier if sufficient force is applied to the first front barrier following the impact.

3. A vehicle safety barrier system according to claim 1 wherein the impact portion is provided at a height greater than the height of the first front barrier.

4. A vehicle safety barrier system according to claim 1 wherein the attachment portion is provided at or adjacent the base of the second rear barrier.

5. A vehicle safety barrier system according to claim 1 wherein the support means are in the form of a frame including a plurality of elongate frame members joined together with spaces defined between at least some of the frame members.

6. A vehicle safety barrier system according to claim 1 wherein a longitudinal axis of the impact portion is substantially parallel to a front surface of said front barrier.

7. A vehicle safety barrier system according to claim 1 wherein at least part of the support means or frame include at least two lateral base members provided substantially perpendicular to said impact portion.

8. A vehicle safety barrier system according to claim 1 wherein the first front barrier is substantially solid.

9. A vehicle safety barrier system according to claim 1 wherein attachment means are provided on or associated with the first front barrier for attaching the first front barrier to a surface in use.

10. A vehicle safety barrier system according to claim 9 wherein said attachment means includes any or any combination of cement, welding, adhesive, one or more clips, nuts and bolts, screws or pins.

11. A vehicle safety barrier system according to claim 1 wherein the first front barrier is between 800-900 mm in height.

12. A vehicle safety barrier system according to claim 1 wherein the first front barrier is a step barrier.

13. A vehicle safety barrier system according to claim 1, further including an upper barrier, wherein the upper barrier is locatable on the first front barrier.

14. A vehicle safety barrier system according to claim 1 wherein at least part of the support means of the second rear barrier forms a substantially U-shaped base.

15. A vehicle safety barrier system according to claim 1 wherein the height of the impact portion on the second rear barrier is adjustable.

16. A method of constructing a vehicle safety barrier system, said barrier system including at least a first front barrier and at least a separate second rear barrier, at least part of said second rear barrier is substantially greater in height than said first front barrier, said second rear barrier including an impact portion and support means for supporting the impact portion, said method including the step of locating the at least second rear barrier a pre-determined spaced distance apart from said first front barrier, attaching the second barrier to the surface on which it is to be located in use, and wherein the first front barrier has a front surface, a rear surface, a top and a base, the front surface being substantially continuous in form from the base to the top, and the second rear barrier is non-continuous in form, the support means having a frame including a plurality of frame members joined together with spaces between some of the frame members.

* * * * *